US007650952B2

(12) United States Patent
Evans et al.

(10) Patent No.: US 7,650,952 B2
(45) Date of Patent: Jan. 26, 2010

(54) PASSIVE VERTICAL DRILLING MOTOR STABILIZATION

(75) Inventors: Nigel Evans, Houston, TX (US); Hugo Roberto Marquez, Rio de Janeiro (BR)

(73) Assignee: Smith International, Inc., Houston, TX (US)

( * ) Notice: Subject to any disclaimer, the term of this patent is extended or adjusted under 35 U.S.C. 154(b) by 128 days.

(21) Appl. No.: 11/509,885

(22) Filed: Aug. 25, 2006

(65) Prior Publication Data

US 2008/0047754 A1 Feb. 28, 2008

(51) Int. Cl.
*E21B 7/04* (2006.01)
*E21B 17/10* (2006.01)

(52) U.S. Cl. ..... 175/61; 175/76; 175/325.4; 175/325.5

(58) Field of Classification Search ..... 175/61, 175/325.5, 76, 352.4
See application file for complete search history.

(56) References Cited

U.S. PATENT DOCUMENTS

| | | | | | |
|---|---|---|---|---|---|
| 4,133,397 | A | * | 1/1979 | Tschirky | 175/96 |
| 4,323,131 | A | * | 4/1982 | Allee | 175/413 |
| 4,433,738 | A | * | 2/1984 | Moreland | 175/61 |
| 4,492,276 | A | * | 1/1985 | Kamp | 175/61 |
| 5,139,094 | A | * | 8/1992 | Prevedel et al. | 175/61 |
| 5,168,941 | A | | 12/1992 | Krueger et al. | |
| 5,311,953 | A | | 5/1994 | Walker et al. | |
| 5,474,143 | A | * | 12/1995 | Majkovic | 175/323 |
| 5,520,255 | A | | 5/1996 | Barr et al. | |
| 5,875,859 | A | | 3/1999 | Ikeda et al. | |
| 6,047,784 | A | * | 4/2000 | Dorel | 175/61 |
| 6,092,610 | A | | 7/2000 | Kosmala et al. | |
| 6,213,229 | B1 | | 4/2001 | Majkovic et al. | |
| 6,513,606 | B1 | | 2/2003 | Krueger et al. | |

FOREIGN PATENT DOCUMENTS

| | | |
|---|---|---|
| EP | 0554977 | 8/1993 |
| GB | 2336171 | 10/1999 |
| GB | 2355275 | 4/2001 |
| WO | 97/44564 | 11/1997 |

OTHER PUBLICATIONS

Webpage: Wenzel Downhold Tools; Multi-point Drilling on Gauge Motors; Aug. 24, 2006; www.downhole.com/products.aspx?NavigationID=30; (1 page).
Combined Search and Examination Report issued in GB Application No. 0716248.0 dated Dec. 20, 2007 (5 pages).
Examination Report issued in British Application No. GB0716248.0, dated Mar. 16, 2009, 2 pages.

* cited by examiner

*Primary Examiner*—Giovanna C Wright
(74) *Attorney, Agent, or Firm*—Osha • Liang LLP

(57) ABSTRACT

A drilling stabilization system includes a power section coupled to an upper end of a transmission housing, a bearing housing coupled to a lower end of the transmission housing, and a drill bit coupled to the bearing housing, wherein the transmission housing includes at least two radially outwardly extending blades disposed on the transmission housing. A method of drilling a substantially concentric wellbore includes drilling a formation with a directional drilling bottomhole assembly coupled to a drill string, changing a direction of the drilling of the formation being drilled, removing the directional drilling bottomhole assembly from the drill string, coupling a drilling stabilization system to the drill string, and drilling the formation with the drilling stabilization system.

15 Claims, 6 Drawing Sheets

PASSIVE VERTICAL DRILLING MOTOR STABILIZATION

BACKGROUND OF INVENTION

1. Field of the Disclosure

Embodiments disclosed herein relate generally to drill strings for drilling concentric wellbores. More specifically, embodiments disclosed herein relate to drilling systems for drilling substantially vertical wellbores and/or concentric tangential sections of directional wellbores.

2. Background Art

Subterranean drilling operations are often performed to locate (exploration) or to retrieve (production) subterranean hydrocarbon deposits. Most of these operations include an offshore or land-based drilling rig to drive a plurality of interconnected drill pipes known as a drill string. Large motors at the surface of the drilling rig may apply torque and rotation to the drill string, and the weight of the drill string components provides downward axial force. At the distal end of the drill string, a collection of drilling equipment known to one of ordinary skill in the art as a bottom hole assembly ("BHA"), is mounted. Typically, the BHA may include one or more of a drill bit, a drill collar, a stabilizer, a reamer, a mud motor, a rotary steering tool, measurement-while-drilling sensors, and any other device useful in subterranean drilling.

While most drilling operations begin as vertical drilling operations, often the borehole drilled does not maintain a vertical trajectory along its entire path. Often, changes in the subterranean formation will dictate changes in trajectory, as the BHA has natural tendency to follow the path of least resistance. For example, if a pocket of softer, easier to drill, formation is encountered, the BHA and attached drill string will naturally deflect and proceed into that softer formation rather than a harder formation. While relatively inflexible at short lengths, drill string and BHA components become somewhat flexible over longer lengths. As borehole trajectory deviation is typically reported as the amount of change in angle (i.e. the "build angle") over one hundred feet, borehole deviation can be imperceptible to the naked eye. However, over distances of over several thousand feet, borehole deviation may be significant.

Many borehole trajectories today desirably include planned borehole deviations. For example, in formations where the production zone includes a horizontal seam, drilling a single deviated bore horizontally through that seam may offer more effective production than several vertical bores. Furthermore, in some circumstances, it is preferable to drill a single vertical main bore and have several horizontal bores branch off therefrom to fully reach and develop all the hydrocarbon deposits of the formation. Therefore, considerable time and resources have been dedicated to develop and optimize directional drilling capabilities.

Typical directional drilling schemes include various mechanisms and apparatuses in the BHA to selectively divert the drill string from its original trajectory. An early development in the field of directional drilling included the addition of a positive displacement mud motor to the bottom hole assembly. In standard drilling practice, the drill string is rotated from the surface to apply torque to the drill bit below. With a mud motor attached to the bottom hole assembly, torque can be applied to the drill bit therefrom, thereby eliminating the need to rotate the drill string from the surface. Particularly, a positive displacement mud motor is an apparatus to convert the energy of drilling fluid into rotational mechanical energy at the drill bit. Alternatively, a turbine-type mud motor may also be used to convert energy of the high-pressure drilling fluid into rotational mechanical energy. In most drilling operations, fluids known as "drilling muds" or "drilling fluids" are pumped down to the drill bit through a bore of the drill string where the fluids are used to clean, lubricate, and cool the cutting surfaces of the drill bit. After exiting the drill bit, the used drilling fluids return to the surface (carrying suspended formation cuttings) along the annulus formed between the cut borehole and the outer profile of the drill string. A positive displacement mud motor typically uses a helical stator attached to a distal end of the drill string with a corresponding helical rotor engaged therein and connected through the mud motor driveshaft to the remainder of the BHA therebelow. As such, pressurized drilling fluids flowing through the bore of the drill string engage the stator and rotor, thus creating a resultant torque on the rotor which is, in turn, transmitted to the drill bit below.

Therefore, when a mud motor is used, it may not be necessary to rotate the drill string to drill the borehole. Instead, the drill string slides deeper into the wellbore as the bit penetrates the formation. To enable directional drilling with a mud motor, a bent housing is added to the BHA. A bent housing appears to be an ordinary section of the BHA, with the exception that a low angle bend is incorporated therein. As such, the bent housing may be a separate component attached above the mud motor (i.e. a bent sub), or may be a portion of the motor housing itself. Using various measurement devices in the BHA, a drilling operator at the surface is able to determine which direction the bend in the bent housing is oriented. The drilling operator then rotates the drill string until the bend is in the direction of a desired deviated trajectory and the drill string rotation is stopped. The drilling operator then activates the mud motor and the deviated borehole is drilled, with the drill string advancing without rotation into the borehole (i.e. sliding) behind the BHA, using only the mud motor to drive the drill bit. When the desired direction change is complete, the drilling operator rotates the entire drill string continuously so that the directional tendencies of the bent housing are eliminated so that the drill bit may drill a substantially straight trajectory. When a change of trajectory is again desired, the continuous drill string rotation is stopped, the BHA is again oriented in the desired direction, and drilling is resumed by sliding the BHA.

One drawback of directional drilling with a mud motor and a bent housing includes repeatedly transitioning between sliding and rotating the drill string, thereby affecting the gage of the hole, lateral loading of the bit, and hole quality. Rotation of a bent housing or bent sub in the hole creates eccentric motion at the bit and in the BHA, thereby causing excessive bit wear and stress on other BHA components as they are rotated through this concentric motion. When the drill string is advancing by sliding, the lateral loading on the bit is reduced. The eccentric motion caused by rotation of the bent housing also causes the bit to drill an overgaged hole, that is, a hole with a diameter larger than the diameter of the drill bit. Thus, combinations of in-gage holes formed during drilling while sliding and overgaged holes formed during drilling while rotating result in ledges in the formations, or cutting catchment areas, that present difficulties when pulling the drilling assembly out of the hole or putting the drilling assembly back in the hole. Further, as the drill string advances, a component of the BHA may "stick" in the formation. Weight build-up on the component that is sticking causes the component to be released or "slip" and move forward. Oftentimes, this "stick-slip" reaction may cause shock damage to the bit and other BHA components.

Another drawback of directional drilling with a mud motor and a bent housing arises when the drill string rotation is stopped and forward progress of the BHA continues with the positive displacement mud motor. During these periods, the drill string slides further into the borehole as it is drilled and does not enjoy the benefit of rotation to prevent it from sticking in the formation. Particularly, such operations carry an increased risk that the drill string will become stuck in the borehole and will require a costly fishing operation to retrieve the drill string and BHA. Once the drill string and BHA is fished out, the apparatus is again run into the borehole where sticking may again become a problem if the borehole is to be deviated again and the drill string rotation stopped. Furthermore, another drawback to drilling without rotation is that the effective coefficient of friction is higher, making it more difficult to advance the drill string into the wellbore. This results in a lower rate of penetration than when rotating, and can reduce the overall "reach", or extent to which the wellbore can be drilled horizontally from the drill rig.

In recent years, in an effort to combat issues associated with drilling without rotation, rotary steerable systems ("RSS") have been developed. In a rotary steerable system, the BHA trajectory is deflected while the drill string continues to rotate. As such, rotary steerable systems are generally divided into two types, push-the-bit systems and point-the-bit systems. In a push-the-bit RSS, a group of expandable thrust pads extend laterally from the BHA to thrust and bias the drill string into a desired trajectory. An example of one such system is described in U.S. Pat. No. 5,168,941. In order for this to occur while the drill string is rotated, the expandable thrusters extend from what is known as a geostationary portion of the drilling assembly. Geostationary components do not rotate relative to the formation while the remainder of the drill string is rotated. While the geostationary portion remains in a substantially consistent orientation, the operator at the surface may direct the remainder of the BHA into a desired trajectory relative to the position of the geostationary portion with the expandable thrusters. An alternative push-the-bit rotary steering system is described in U.S. Pat. No. 5,520,255, in which lateral thrust pads are mounted on a body which is connected to and rotates at the same speed as that of the rest of the BHA and drill string. The pads are cyclically driven, controlled by a control module with a geostationary reference, to produce a net lateral thrust which is substantially in the desired direction.

In contrast, a point-the-bit RSS includes an articulated orientation unit within the assembly to "point" the remainder of the BHA into a desired trajectory. Examples of such a system are described in U.S. Pat. Nos. 6,092,610 and 5,875,859. As with a push-the-bit RSS, the orientation unit of the point-the-bit system is either located on a geostationary collar or has either a mechanical or electronic geostationary reference plane, so that the drilling operator knows which direction the BHA trajectory will follow. Instead of a group of laterally extendable thrusters, a point-the-bit RSS typically includes hydraulic or mechanical actuators to direct the articulated orientation unit into the desired trajectory. While a variety of deflection mechanisms exist, what is common to all point-the-bit systems is that they create a deflection angle between the lower, or output, end of the system with respect to the axis of the rest of the BHA. While point-the-bit and push-the-bit systems are described in reference to their ability to deflect the BHA without stopping the rotation of the drill string, it should be understood that they may nonetheless include positive displacement mud motors or turbine motors to enhance the rotational speed applied to the drill bit.

Steerable motors having a drilling or mud motor with a fixed bend in a housing thereof that creates a side force on the drill bit and one or more stabilizers to position and guide the drill bit in the borehole are generally considered to be the first systems to allow predictable directional drilling. However, the compound drilling path is sometimes not smooth enough to avoid problems with completion of the well. Also, rotating the bent assembly produces an undulated well with changing diameter, which may lead to a rough well profile and hole spiraling which subsequently might require time consuming reaming operations. Another limitation with steerable motors is the need to stop rotation for the directional drilling section of the wellbore, which can result in poor hole cleaning and a higher equivalent circulating density at the wellbore bottom. This may increase the frictional forces, which makes it more difficult to move the drill bit forward or downhole. Further, control of the tool face orientation of the motor may be more difficult.

To overcome the above-noted difficulties with steerable drilling motor assemblies lead to the development of so called "self-controlled" or active drilling systems. Such systems generally have some capability to follow a planned or predetermined drilling path and to correct for deviations from the planned path. These systems, however, enable faster, and to a varying degree, a more direct and tailored response to potential deviation for directional drilling. Such systems can change the direction behavior downhole, thereby reducing dog leg severity.

A straight hole drilling device (SDD) is often used in drilling vertical holes. A SDD typically includes a straight drilling motor with a plurality of steering ribs, usually two opposite ribs each in orthogonal planes on a bearing assembly near the drill bit. The ribs may be hardfaced or may include tungsten carbide insert (TCI) inlays and are typically configured to sit flush with the hole wall. Such configuration of the ribs may cause drag as the drilling assembly moves downward in the wellbore and may catch or "hang-up" on the formation.

In recent years, square motor housings have been coupled to the drill string for steering and stabilization of the BHA in forming vertical wellbores. The four edges that form the square motor are in substantially constant contact with the wall of the wellbore as the BHA moves down the wellbore. Thus, the square motor provides rigidity of the BHA, thereby maintaining the vertical trajectory of the drill string and reducing the deviation of the drill string due to, for example, formation changes. The square motor, however, produces a lot of friction, and therefore drag, due to the area of contact between the length of the four edges of the square motor and the wall of the formation. These motors also tend to be very noisy while moving the drill string and motor downhole.

Deviations from the vertical are measured by two orthogonally mounted inclination sensors. Either one or two ribs may be actuated to direct the drill bit back onto the vertical course. Valves and electronics, usually mounted above the drilling motor, control the actuation of the ribs. Mud pulse or other telemetry systems are used to transmit inclination signals to the surface. Lateral deviation of boreholes from the planned course (radial displacement) achieved with such SDD systems has been nearly two orders of magnitude smaller than with conventional assemblies. SDD systems have been used to form narrow cluster boreholes and less tortuous boreholes, thereby reducing or eliminating reaming requirements.

A multi-point drilling assembly with a stabilized motor is also known in the art. The multi-point drilling assembly includes a set of reamer cutters incorporated in a bit box which acts as a roller bearing, guiding the drill bit. Stabilizers on the bearing assembly and the stator, also known as the power section, reduce deviation of the drill sting while drilling. The reamer cutters also act to cut the wellbore once the drill bit starts to wear, thereby reducing the amount of undergauged hole. One example of such an assembly is provided by Wenzel Downhole Tools (Oklahoma City, Okla.).

Automated drilling systems having ribs mounted on non-rotating sleeves near the drill bit, wherein each rib may be individually actuated, are known in the art. For example, AutoTrak®, by Baker Hughes Incorporated (Houston, Tex.), has three hydraulically-operated stabilizer ribs mounted on a non-rotating sleeve. Integrated formation evaluation sensors allow steering based on directional parameters and reservoir changes, thereby guiding the bit in the desired direction. A drilling motor may be used to drive the entire assembly, thereby providing more power to the bit. The ribs may be integrated into the bearing assembly of the drilling motor.

Automated drilling systems and rotary steerable systems typically include equipment that is expensive to manufacture and operate. The cost of running an automated drilling system or a rotary steerable system may cost any where from $25,000/day to $40,000/day.

Accordingly, there exists a need for a more cost efficient drilling system that drills a concentric wellbore along a vertical trajectory. Additionally, there exists a need for a more cost efficient drilling system that drills a concentric wellbore along a deviate trajectory. Further, there exists a need for drilling system that minimizes the tortuousity of wellbore and reduces localized dog-leg severity. Still further, there exists a need for a stabilized drilling system with reduced damage to the wall of the wellbore.

SUMMARY OF INVENTION

In one aspect, embodiments disclosed herein relate to a drilling stabilization system that includes a power section coupled to an upper end of a transmission housing, a bearing housing coupled to a lower end of the transmission housing, and a drill bit coupled to the bearing housing, wherein the transmission housing includes at least two radially outwardly extending blades disposed on the transmission housing.

In another aspect, embodiments disclosed herein relate to a drilling stabilization system that includes a power section coupled to an upper end of a transmission housing, a bearing housing coupled to a lower end of the transmission housing, and a drill bit coupled to a lower end of the bearing housing, wherein the bearing housing comprises at least two radially outwardly extending blades disposed on the bearing housing and a plurality of stabilizing contact point elements disposed on the at least two radially outwardly extending blades.

In another aspect, embodiments disclosed herein relate to a transmission housing of a drill string that includes a tubular member configured to receive a motor transmission, at least two radially outwardly extending blades disposed on the tubular member, and a plurality of stabilizing contact point elements disposed on the at least two radially outwardly extending blades.

In yet another aspect, embodiments disclosed herein relate to a method of drilling a substantially concentric wellbore, the method including drilling a formation with a directional drilling bottomhole assembly coupled to a drill string, changing a direction of the drilling of the formation being drilled, removing the directional drilling bottomhole assembly from the drill string, coupling a drilling stabilization system to the drill string, and drilling the formation with the drilling stabilization system.

Other aspects and advantages of the invention will be apparent from the following description and the appended claims.

DETAILED DESCRIPTION

In one aspect, embodiments disclosed herein relate to a passive drilling stabilization system for maintaining a selected angle of drilling and avoiding dog legs. In another aspect, embodiments disclosed herein relate to a passive drilling stabilization system for maintaining a nominal gage of wellbore being drilled. In yet another aspect, embodiments disclosed herein relate to a method of drilling a concentric wellbore.

Figure 1A:
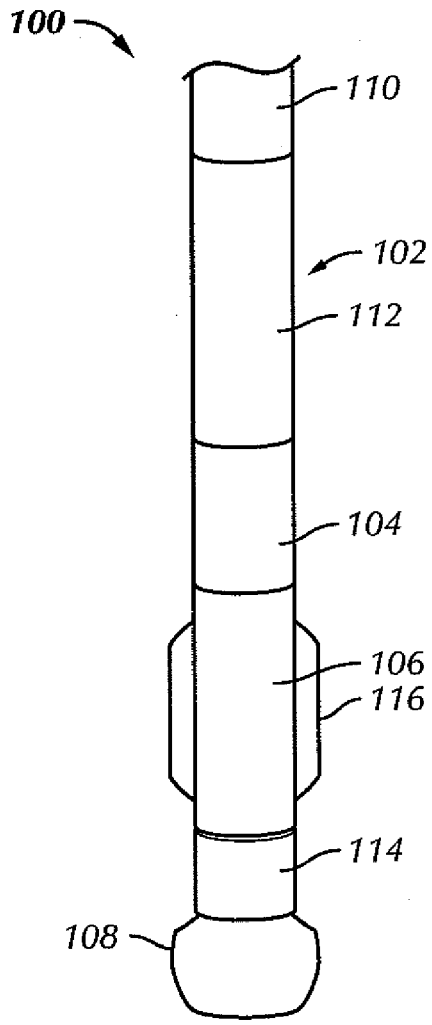
FIGS. 1A and 1B show a drilling stabilization system in accordance with embodiments disclosed herein.
Figure 1B:
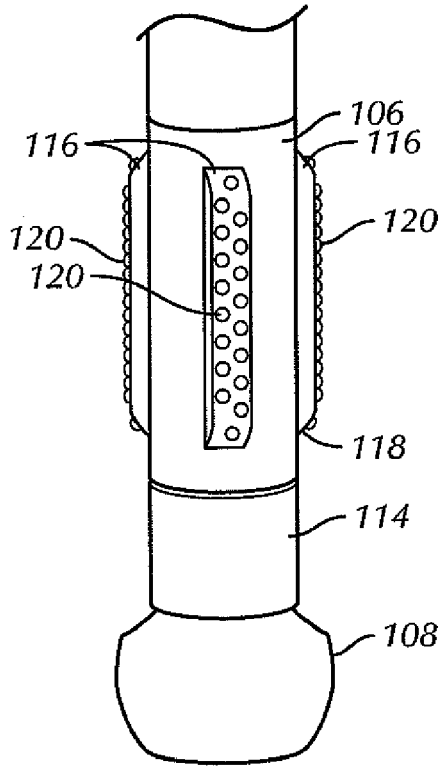

FIGS. 1A and 1B show an example of a BHA for drilling a wellbore in a formation in accordance with embodiments disclosed herein. As shown, a drilling stabilization system 100 in accordance with embodiments disclosed herein includes a motor 102, a bearing housing 106, and a drill bit 108. In one embodiment, motor 102 may be a positive displacement motor (PDM). Motor 102 may be suspended in the well from a threaded tubular, for example, drill string 110. Alternatively, motor 102 may be suspended in the well from coiled tubing (not shown). Motor 102 may include a motor drive sub 114, a power section 112, and a transmission housing 104. Power section 112 may include a conventional lobed rotor (not shown) for rotating a motor output shaft (not shown), and thereby rotating motor drive sub 114, in response to fluid being pumped through power section 112. In this embodiment, fluid flows through the motor stator (not shown) to rotate the axially curved or lobed rotor (not shown). Transmission housing 104 is disposed axially below power section 112. Transmission housing 104 houses a motor transmission including equipment, as known in the art, for converting eccentric motion of power section 112 to concentric motion for bearing assembly 106. As shown, transmission housing 104 has a substantially cylindrical outer surface and may be configured to couple with a lower end of power section 112 and an upper end of bearing assembly 106. Coupling of transmission housing 104, power section 112 and bearing assembly 106 may be performed by any method known in the art. For example, in one embodiment, transmission housing 104 may be integrally formed with power section 112 or, in an alternate embodiment, transmission housing 104 may be mechanically coupled to power section 112 and bearing assembly 106. For example, transmission housing 104 may be threadedly engaged with a lower end of power section 112 and threadedly engaged with an upper end of bearing housing 106. One of ordinary skill in the art will appreciate that bearing housing 106 may house a bearing package assembly (not shown) that comprises, for example, thrust bearings and radial bearings.

As shown in FIGS. 1A and 1B, bearing housing 106 may include at least two blades 116 radially outwardly extending from the otherwise uniform diameter cylindrical outer surface of bearing housing 106. One of ordinary skill in the art will appreciate that any number of radially outwardly extending blades 116 may be disposed on bearing housing 106, for example, three blades, four blades, or more. In contrast to conventional steering blade components, where the blades may be formed on a sleeve that is threaded over a bearing housing, in one embodiment disclosed herein, the at least two blades 116 may be integrally formed with bearing housing 106. Alternatively, the at least two blades 116 may be coupled to bearing housing 106 by any method know in the art, for example, welding or bolting. As shown, the at least two blades 116 may include a tapered surface 118 disposed on each axial end of each blade 116.

Referring now to FIG. 1B, in one embodiment, a plurality of stabilizing contact point elements 120 may be disposed on an outer surface of the at least two blades 116. Stabilizing contact point elements 120 may be configured to provide a plurality of contact points between the at least two blades 116 and a wall of the wellbore (not shown). Stabilizing contact point elements 120 may provide stabilization of transmission housing 104, and therefore motor 102, while minimizing damage to or cutting of the wall of the wellbore.

Figure 2:
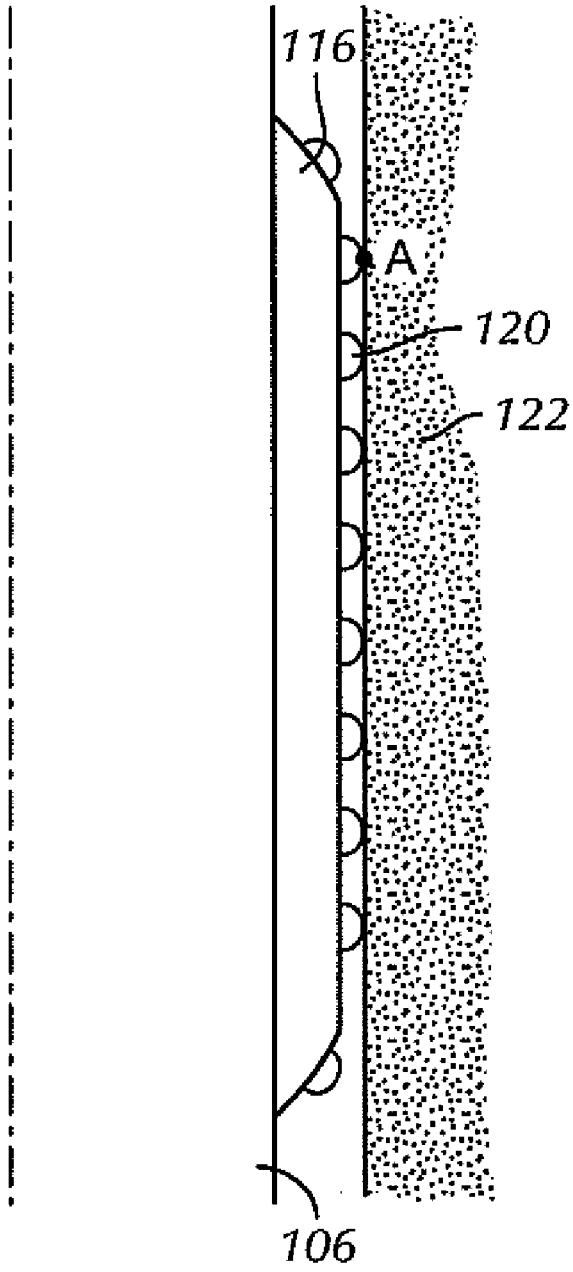
FIG. 2 is a partial cross-sectional view of a drilling stabilization system in accordance with embodiments disclosed herein.

As shown in FIG. 2, in one embodiment, stabilizing contact point elements 120 may include a plurality of inserts. One of ordinary skill in the art will appreciate that the plurality of inserts may be attached to each blade 116 by any method know in the art, for example, brazing, press fitting, and welding. In one embodiment, the plurality of inserts may include diamond enhanced inserts (DEI). As shown, in some embodiments, stabilizing contact point elements 120 may include a plurality of inserts having a dome shape. In this embodiment, the plurality of dome-shaped inserts provide a series of relatively small contact points, indicated at A, between each blade 116 of bearing housing 106 and a wall 122 of the wellbore. Accordingly, the total surface area of contact between the plurality of stabilizing contact point elements 120 and wall 122 of the wellbore is relatively small, thereby reducing damage to the formation or wall 122 of the wellbore, while still providing sufficient stabilization of motor 102.

Figure 3:
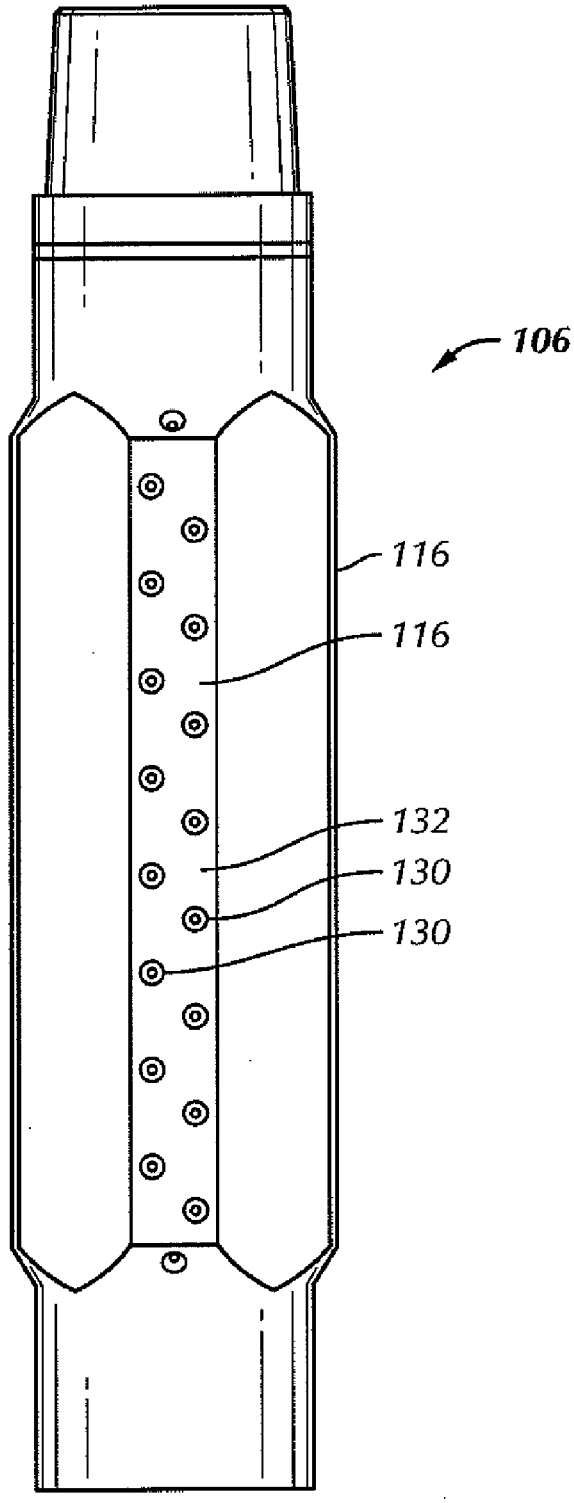
FIG. 3 shows a bearing housing in accordance with embodiments disclosed herein.

As shown in more detail in FIG. 3, bearing housing 106 has a substantially cylindrical outer surface and may be configured to couple with a lower end of transmission housing 104 (FIG. 1A), as described above. A lower end of bearing housing 106 may be configured to couple with an upper end of the motor drive sub 114 (FIG. 1A). As shown, at least two blades 116 are integrally formed on the outer surface of bearing housing 106. A plurality of holes 130 may be formed on outer surface 132 of the at least two blades 116 for receiving a plurality of stabilizing contact point elements (e.g., 120 of FIG. 1B).

Figure 4A:
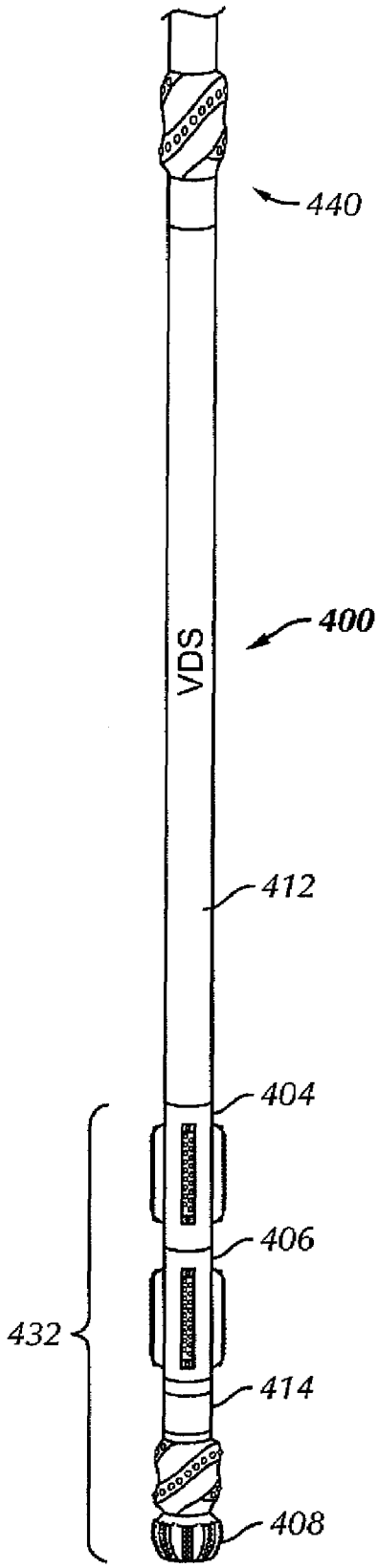
FIGS. 4A and 4B show a drilling stabilization system in accordance with embodiments disclosed herein.
Figure 4B:
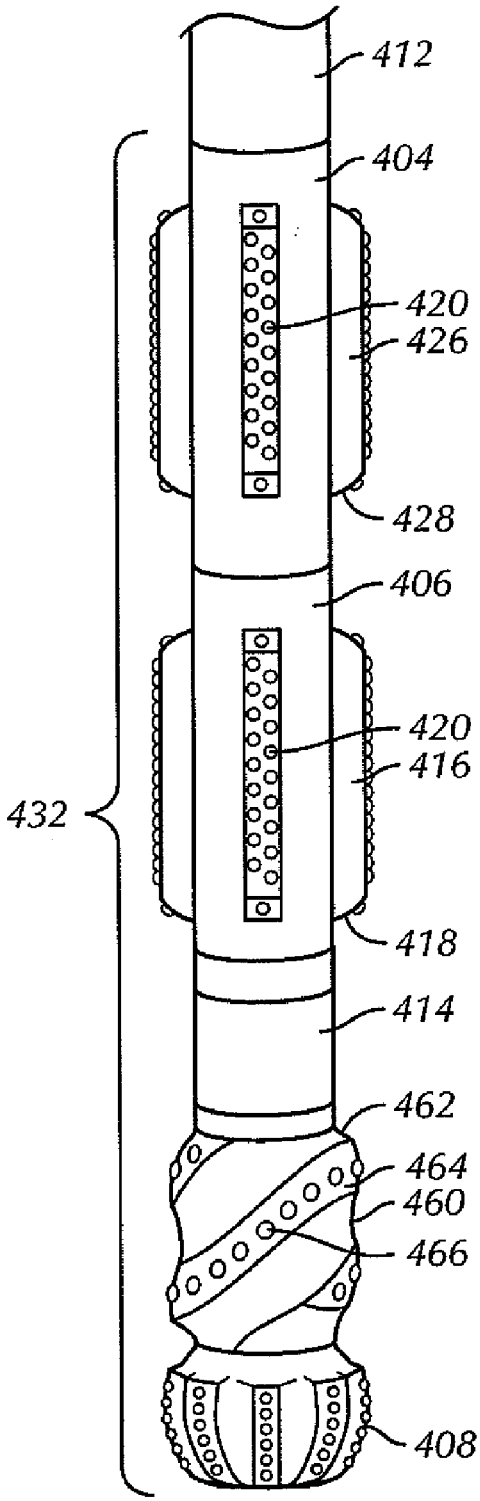

FIGS. 4A and 4B show a drilling stabilization system 400 coupled to a drill string 440 in accordance with an embodiment disclosed herein. As discussed above, drilling stabilization system 400 may include a motor (not shown), a power section 412, a transmission housing 404, a bearing housing 406, and a drill bit 408. As shown, transmission housing 404 is threadedly coupled with a lower end of power section 412 and bearing housing 406 is threadedly coupled with a lower end of transmission housing 404.

Referring now to FIG. 4B, bearing housing 406 may include at least two blades 416 radially outwardly extending from the otherwise uniform diameter cylindrical outer surface of bearing housing 406. One of ordinary skill in the art will appreciate that any number of radially outwardly extending blades 416 may be disposed on bearing housing 406, for example, three blades, four blades, or more. In contrast to conventional steering blade components, where the blades may be formed on a sleeve that is threaded over the bearing housing, in the embodiment shown, the at least two blades 416 are integrally formed with bearing housing 406. Alternatively, the at least two blades 416 may be coupled to bearing housing 406 by any method know in the art, for example, welding or bolting. As shown, the at least two blades 416 may include a tapered surface 418 disposed on each axial end of each blade 416 that helps guide the BHA into the wellbore when inserting it at the surface.

In one embodiment, transmission housing 404 may include at least two blades 426 radially outwardly extending from the otherwise uniform diameter cylindrical outer surface of transmission housing 404. One of ordinary skill in the art will appreciate that any number of radially outwardly extending blades 426 may be disposed on transmission housing 404, for example, three blades, four blades, or more. In the embodiment shown, the at least two blades 426 are integrally formed with transmission housing 404. Alternatively, the at least two blades 426 may be coupled to transmission housing 404 by any method know in the art, for example, welding or bolting. As shown, the at least two blades 426 may include a tapered surface 428 disposed on each axial end of each blade 426 that helps guide the BHA into the wellbore when inserting it at the surface.

In some embodiments, a plurality of stabilizing contact point elements 420 may be disposed on an outer surface of blades 416, 426 of the bearing housing 406 and the transmission housing 404, respectively. Stabilizing contact point elements 420 may be configured to provide a plurality of contact points between the at least two blades 416 of bearing housing 406 and the at least two blades 426 of transmission housing 404, and a wall of the wellbore (not shown). Stabilizing contact point elements 420 may provide stabilization of a motor while minimizing damage to the wall of the wellbore.

Furthermore, stabilizing contact point elements 420 may include a plurality of inserts disposed in a plurality of holes formed on the outer surface of the at least two blades 416 of bearing housing 406 and the at least two blades 426 of transmission housing 404. One of ordinary skill in the art will appreciate that inserts may be attached to each blade 416, 426 by any method know in the art, for example, brazing, press fitting, and welding. In one embodiment, the plurality of inserts may include diamond enhanced inserts (DEI). In some embodiments, stabilizing contact point elements 420 may include a plurality of inserts having a dome shape (see FIG. 2). In this embodiment, the plurality of dome-shaped inserts may provide a series of relatively small contact points between each blade 416, 426 and a wall of the wellbore (not shown). Accordingly, the total surface area of contact between the plurality of stabilizing contact point elements 420 and wall of the wellbore (not shown) is relatively small, thereby reducing damage to the formation or wall of the wellbore (not shown), while still providing sufficient stabilization of the BHA.

In the embodiment shown in FIGS. 4A and 4B, the blades 416, 426 of bearing housing 406 and transmission housing 404, respectively, are located in a critical lower end 432 of drill string 440. Stabilization of the critical lower end 432 of drill string 440 may provide directional stability of the drill string 440 as the bit 408 drills the formation. The critical lower end 432 of drill string 440 may be defined as the downhole end of a drill sting, including portions of the BHA, that are disposed below the power section 412 of a motor. In particular, stabilizers such as the blades 416, 426 of bearing housing 406 and transmission housing 404, respectively, disposed proximate to drill bit 408 may provide enhanced stabilization of the BHA. Accordingly, in this embodiment, the critical lower end 432 of drill string 440 includes transmission housing 404, bearing housing 406, a motor drive sub 414, and bit 408.

The blades 416, 426 of bearing housing 406 and transmission housing 404, respectively, may provide stability of the critical lower end 432 by reducing or minimizing the amount of flex of critical lower end 432 as it moves downward through the formation. In one example, on a drill string configured to drill an approximately 8½ inch hole, the axial distance from the tip of drill bit 408 to a top of the at least two blades 426 disposed on transmission housing 404 may be approximately 5 to 6 feet. In another example, on a drill string configured to drill an approximately 12¼ inch hole, the axial distance from the tip of drill bit 408 to the top of the at least two blades 426 disposed on transmission housing 404 may be approximately 6 to 7 feet. Thus, minimization of flex of the critical lower end 432 minimizes deviation of bit 408 from a planned trajectory. Accordingly, a BHA with a drilling stabilization system in accordance with embodiments disclosed herein may follow a substantially vertical trajectory regardless of variations in the formation. Further, a drilling stabilization system in accordance with embodiments disclosed herein may enable a BHA to maintain a directional trajectory, that is, a trajectory that is angled from the vertical line of the wellbore, with less deviation than a traditional BHA.

Referring now to FIG. 4B, in one embodiment, a longitudinal, cylindrical, reaming stabilizer 460 may be coupled to a lower end of motor drive sub 414 and an upper end of drill bit 408. The stabilizer 460 has longitudinal flutes 462 and lands 464. The flutes 462 are configured to allow fluid flow back past the stabilizer 460 (for this reason the flutes 462 may be referred to as "junk slots"). The lands 464 define an outer transverse diameter of reaming stabilizer 460. In some embodiment, the lands 464 and flutes 462 may be spirally arranged. One of ordinary skill in the art will appreciate that any number of flutes and lands may be used, for example, in one embodiment, there may be six lands 464 and six flutes 462.

Furthermore, lands 464 on the stabilizer 460 may be provided with a plurality of hardened inserts 466 extending outwardly from lands 464. In this embodiment, outer edges of the inserts 466 may define the transverse diameter of reaming stabilizer 460. The hardened inserts 466 may include a hardened surface, such as a polycrystaline diamond or tungsten carbide, for engaging a formation. In one embodiment, hardened inserts 466 may be removably mounted in reaming stabilizer 460 by brazing, for example by silver brazing the inserts 466 into a hole formed on lands 464. Alternatively, inserts 466 may be tight fit in reaming stabilizer 460 in holes formed on lands 464. In one embodiment, the transverse diameter of drill bit 408 is larger than the transverse diameter of reaming stabilizer 460. Alternatively, the transverse diameter of drill bit 408 is substantially the same as the transverse diameter of reaming stabilizer 460. Accordingly, when the drill bit 408 wears down to less than gage diameter, the reaming stabilizer 460 will engage the formation and function as a reamer. One example of a reaming stabilizer 460 is disclosed in U.S. Pat. No. 6,213,229, assigned to the assignee of the present disclosure, and is incorporated by reference in its entirety.

In one embodiment, drilling stabilization system 400 may be coupled to a drill string and lowered into a wellbore. As the bit drills the formation, the plurality of stabilizing contact point elements 420 disposed on blades 416, 426 of bearing housing 406 and transmission housing 404, respsectively, may contact the wall of the wellbore (not shown), thereby reducing vibrations of the drill string. The dome-like shape of the plurality of contact point elements 420, in accordance with embodiments disclosed herein, in combination with the stiffness or rigidity of the BHA provided by two sets of at least two blades 416, 426 disposed proximate the drill bit 408, allow the BHA to drill the formation with reduced drag while maintaining concentricity of the planned trajectory.

Figure 5:
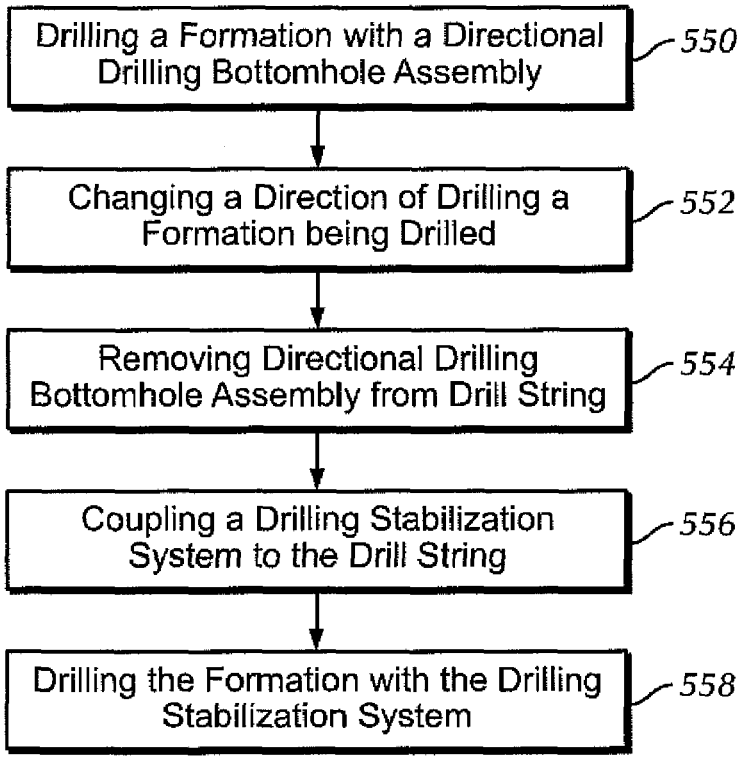
FIG. 5 is a flowchart showing a method of drilling a formation in accordance with embodiments disclosed herein.

FIG. 5 shows a method of drilling a wellbore in accordance with embodiments disclosed herein. In one embodiment, a formation may be drilled with a directional drilling BHA 550 that may include one or more of a drill bit, a drill collar, a stabilizer, a reamer, a mud motor, a rotary steering tool, measurement-while-drilling sensors, and any other device useful in subterranean drilling. The directional drilling BHA may be any BHA known in the art, for example, a rotary steering system or an automated drilling system, as described above. The directional drilling BHA may then be used to deviate the trajectory of the planned wellbore by, for example, actuating a hydraulic rib on a stabilizer sleeve to move the BHA in an angled direction. Accordingly, the direction of drilling the formation may be changed 552. Next, the drill string may be pulled to the surface and the directional drilling BHA removed from the drill string 554 once the wellbore has been deviated from an original trajectory, for example, from a vertical trajectory.

Next, a drilling stabilization system in accordance with embodiments disclosed herein may be coupled to the drill string 556 and lowered into the wellbore. The drilling stabilization system coupled to the drill string may be lowered into the deviated wellbore and the formation may be drilled with the drilling stabilization system 558. Accordingly, the drilling stabilization system may drill the formation and maintain the deviated trajectory of the wellbore initiated by the directional drilling BHA. Because a drilling stabilization system in accordance with embodiments disclosed herein is a passive system, that is, stabilization of the system does not require automated or actuated parts, the cost of operating the system may be significantly less than an active system.

Advantageously, embodiments disclosed herein may provide a drilling stabilization system for drilling substantially concentric vertical wellbores with reduced deviations from a planned vertical trajectory. In addition, embodiments described herein may provide a more efficient and economical drilling stabilization system for drilling a concentric wellbore. Embodiments disclosed herein may also advantageously provide a drilling stabilization system for drilling a formation that maintains a deviated trajectory. Further, embodiments described herein may provide a method for drilling a formation along a deviated trajectory while maintaining the deviated trajectory. Still further, a drilling stabilization system in accordance with embodiments described herein may provide a stable and stiff BHA with reduced friction and a higher rate of penetration. Yet further, a drilling stabilization system in accordance with embodiments described herein may provide stabilizing contact point elements that provide stabilization of the BHA with reduced damage to or cutting of the formation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drilling stabilization system comprising:

a motor further comprising a power section;

a transmission housing, wherein the power section is coupled to an upper end of the transmission housing, and wherein the transmission housing houses a transmission;

at least two radially outwardly extending blades disposed on an outer surface of the transmission housing that is radially adjacent the transmission;

a bearing housing coupled to a lower end of the transmission housing; and a drill bit coupled to the bearing housing, wherein the drilling stabilization system is configured for passive drilling.

2. The drilling stabilization system of claim 1, wherein the at least two radially outwardly extending blades are integrally formed with the transmission housing.

3. The drilling stabilization system of claim 1, wherein the bearing housing comprises at least two radially outwardly extending blades disposed on the bearing housing.

4. The drilling stabilization system of claim 3, wherein the bearing housing further comprises a plurality of stabilizing contact point elements disposed on an outer surface of the at least two radially outwardly extending blades disposed on the bearing housing.

5. The drilling stabilization system of claim 1, further comprising a reaming stabilizer coupled to an upper end of the drill bit.

6. The drilling stabilization system of claim 1, wherein the power section comprises at least one of a positive displacement motor and a turbine motor.

7. The drilling stabilization system of claim 1, wherein the blades disposed on transmission housing do not substantially rotate relative to the drill bit.

8. The drilling stabilization system of claim 1, wherein the set of at least two radially outwardly extending blades include a plurality of stabilizing point elements configured to minimize a friction between a wall of a wellbore and the transmission housing during operation.

9. The drilling stabilization system of claim 8, wherein the plurality of stabilizing contact point elements comprises dome shaped inserts.

10. The drilling stabilization system of claim 8, wherein the plurality of stabilizing contact point elements comprises diamond enhanced inserts.

11. The drilling stabilization system of claim 1, comprising a reaming stabilizer coupled to an upper end of the drill bit and wherein the bearing housing comprises at least two radially outwardly extending blades disposed on the bearing housing.

12. A passive drilling stabilization system comprising:

a motor further comprising a power section;

a transmission housing, wherein the power section is coupled to an upper end of a transmission housing, and wherein the transmission housing houses a transmission;

a bearing housing coupled to a lower end of the transmission housing; and a drill bit coupled to a lower end of the bearing housing, wherein the bearing housing comprises at least two radially outwardly extending blades disposed on the bearing housing and a plurality of stabilizing contact point elements disposed on at least a portion of an outermost surface of the at least two radially outwardly extending blades.

13. The passive drilling stabilization system of claim 12, further comprising at least two radially outwardly extending blades disposed on an outer surface of the transmission housing that is radially adjacent the transmission, and a plurality of stabilizing contact point elements disposed on the at least two radially outwardly extending blades disposed on the transmission housing.

14. A method of drilling a substantially concentric wellbore, the method comprising:

providing a drill stabilization system comprising, a power section coupled to a transmission housing;

a bearing housing coupled to the transmission housing; and a drill bit coupled to the bearing housing, wherein the transmission housing comprises at least two radially outwardly extending blades disposed on the transmission housing, drilling a formation with a directional drilling bottomhole assembly coupled to a drill string;

changing a direction of drilling of the formation being drilled;

removing the directional drilling bottomhole assembly from the drill string;

coupling the drilling stabilization system to the drill string; and drilling the formation with the drilling stabilization system.

15. The method of claim 14, wherein the directional drilling bottomhole assembly is automated.

* * * * *